United States Patent [19]

Ohara et al.

[11] 4,160,221

[45] Jul. 3, 1979

[54] UNIQUE TIMING DEVICE CONSTRUCTION

[75] Inventors: Isamu Ohara, Okayama; Tsutomu Muranaka, Tamano; Hideo Eizumi, Okayama, all of Japan

[73] Assignee: Omron Tateisi Electronics Co., Kyoto, Japan

[21] Appl. No.: 839,302

[22] Filed: Oct. 4, 1977

[30] Foreign Application Priority Data

Oct. 4, 1976 [JP] Japan ..... 51-133552[U]
Oct. 12, 1976 [JP] Japan ..... 51-137260[U]

[51] Int. Cl.[2] ..... H01H 3/42

[52] U.S. Cl. ..... 335/68; 335/59; 335/73

[58] Field of Search ..... 335/68–76, 335/59, 65, 118

[56] References Cited

U.S. PATENT DOCUMENTS

| | | | |
|---|---|---|---|
| 3,611,216 | 10/1971 | Matsuo et al. | 335/68 |
| 3,693,119 | 9/1972 | Nakama et al. | 335/59 |
| 4,080,583 | 3/1978 | Fujita | 335/75 |

*Primary Examiner*—Harold Broome
*Attorney, Agent, or Firm*—Stevens, Davis, Miller & Mosher

[57] ABSTRACT

A motor driven timing device is provided with a molded plastic frame having an electromagnet, a motor, a contact assembly, and a contact actuator attached thereto. The molded plastic frame is partially sandwiched between the electromagnet and a mounting base member to which the electromagnet is fixed.

11 Claims, 5 Drawing Figures

UNIQUE TIMING DEVICE CONSTRUCTION

CROSS REFERENCE TO RELATED APPLICATIONS

This application is related to the subject matter described and claimed in Ser. No. 839,304 filed Oct. 4, 1977 in the name of OHARA et al entitled "Timing Device Utilizing a Unique Clutch Assembly".

BRIEF SUMMARY OF THE INVENTION

This invention relates to a motor driven electrical timing device utilizing an improved arrangement of components and mounting structures.

Conventional motor driven electrical timing devices are relatively complex, large, and expensive. Many screws or other fastening devices are used in their assembly, especially for holding the commonly employed electromagnet, which is the heaviest of the components, thereby rendering their assembly difficult and time consuming. One or more insulating spacers are often used to achieve the electrical separation needed between the components, otherwise additional wasted space would be unavoidable.

Accordingly, an object of the present invention is to provide a timing device which is easy to assemble.

Another object of the present invention is to provide a timing device of simple, low-cost construction.

A further object of the present invention is to provide a timing device having fewer components which are arranged in a unique relationship.

A still further object of the present invention is to provide a timing device having the large components firmly fixed by only a few screws.

These and other advantages are obtained by providing a timing device comprising a molded plastic frame to which an electromagnet, a motor, a contact assembly, and a contact actuator are attached, a housing, and a mounting base member. The molded frame is partially sandwiched between the electromagnet and the base member to which the electromagnet is fixed by two fasteners, such as screws. Other components of the timing device may also be fastened to the molded plastic frame.

The nature of the invention, including the foregoing and other objects and novel features, will be more fully appreciated from the following detailed description when taken in conjunction with the accompanying drawings.

DESCRIPTION OF THE PREFERRED EMBODIMENT

Figure 1:
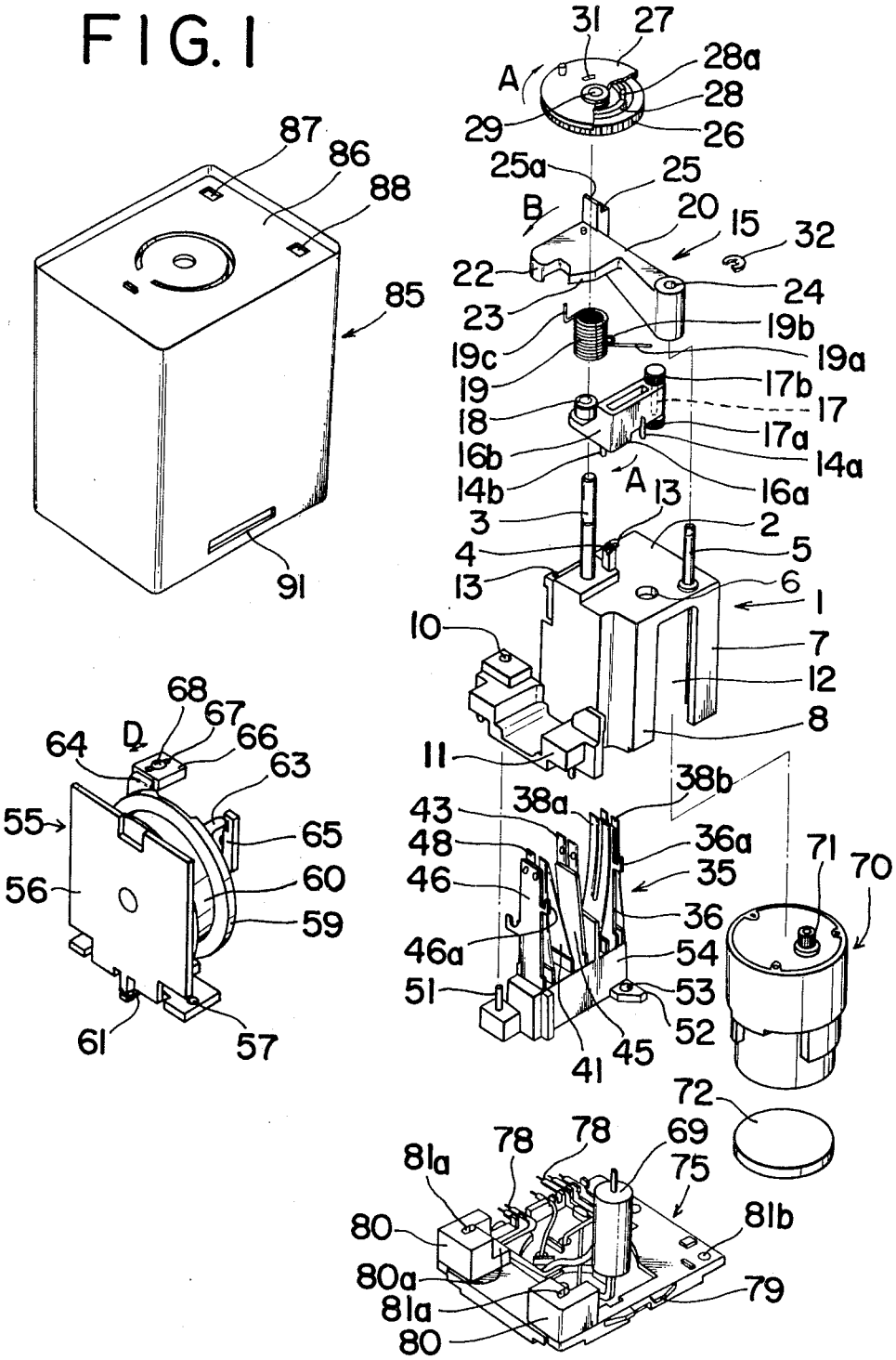
FIG. 1 shows an exploded perspective view of a timing device of an embodiment of the present invention.

Referring to the drawings, an electrical timing device in one embodiment of the present invention comprises a molded frame 1, contact actuator 15, contact assembly 35, motor 70, base member 75, and housing 85. The molded frame 1 is made of plastic and includes a mounting base 2 for mounting a contact actuator 15, supporting portions 7 and 8, a terminal holder 9, and an attaching portion 11 for attaching an electromagnet 55.

The contact actuator 15 includes an L-shaped arm 16 which is rotatably mounted about a stationary shaft 3 through a boss 18 formed at one end of the arm 16, an actuator 20, and a driven gear 26. Two gears **17*a*, 17*b*, are fixedly mounted on a shaft 17 and are mounted on the other end of arm 16 for pivotal movement about shaft 3. A spring 19 is placed around boss 18 with a coil 19*b* wound about a lug 4 in a direction opposite to that of the spring 19. One end 19*a* of spring 19 urges the arm 16 in the direction shown by arrow A until restricted by face 16*b* abutting lever 63 of an electromagnet 55. The other end 19*c* of spring 19 is attached to a through hole 31 formed on a plate 27 which is part of a driven gear 26, so as to urge the plate 27** in the direction shown by arrow A.

Actuator 20 includes actuating projections 21 (FIG. 2), 22 and a lug 23, and is rotatably mounted on the stationary shaft 5 and retained in position by an E-ring 32. The actuator 20 also includes a projection 25 which can be seen through an indicating window 87 formed on the timing device housing 85 when the actuator 20 rotates after a present time period has expired. The plate 27 and a cam 28 with a cut-out portion **28*a* are united with a driven gear 26 and are rotatably mounted on the stationary shaft 3 through a center hole 29**.

Figure 2:
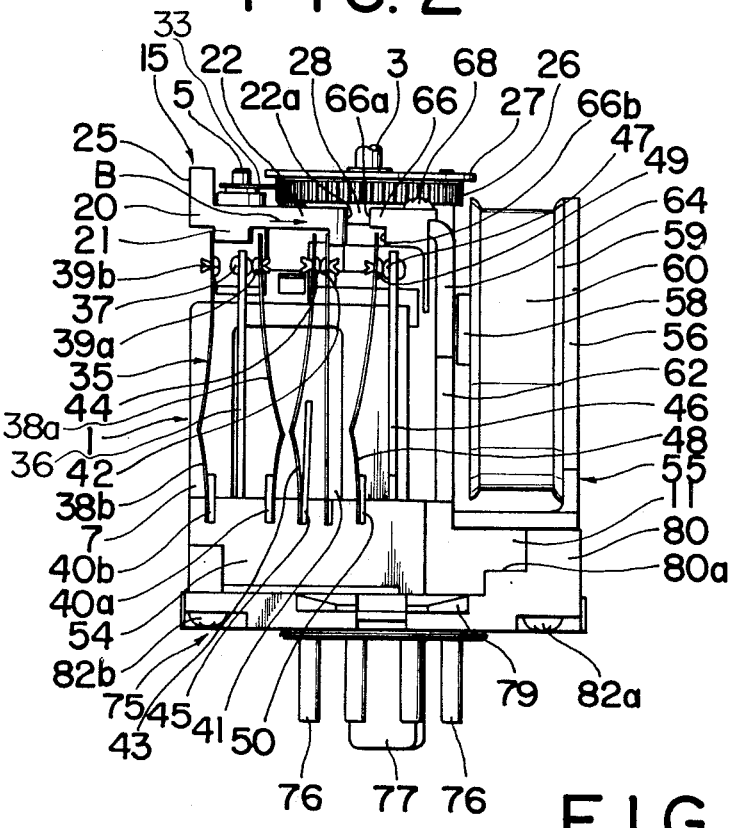
FIG. 2 shows a schematic elevational, partly sectional, view of the embodiment shown in FIG. 1.
Figure 3:
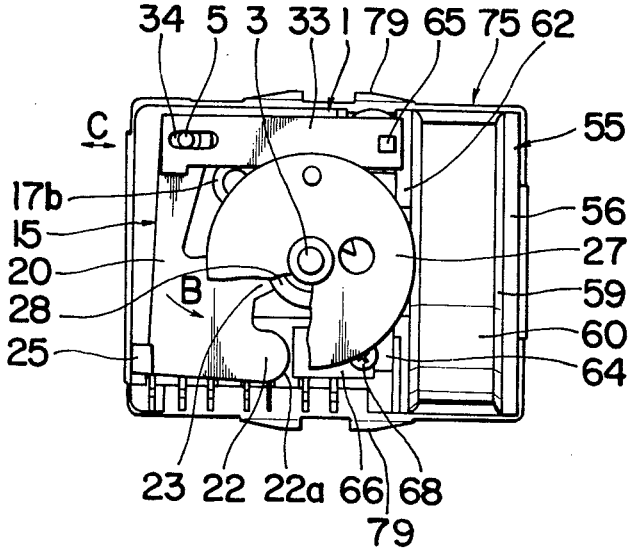
FIG. 3 shows a schematic plan view of the embodiment shown in FIG. 1.
Figure 4:
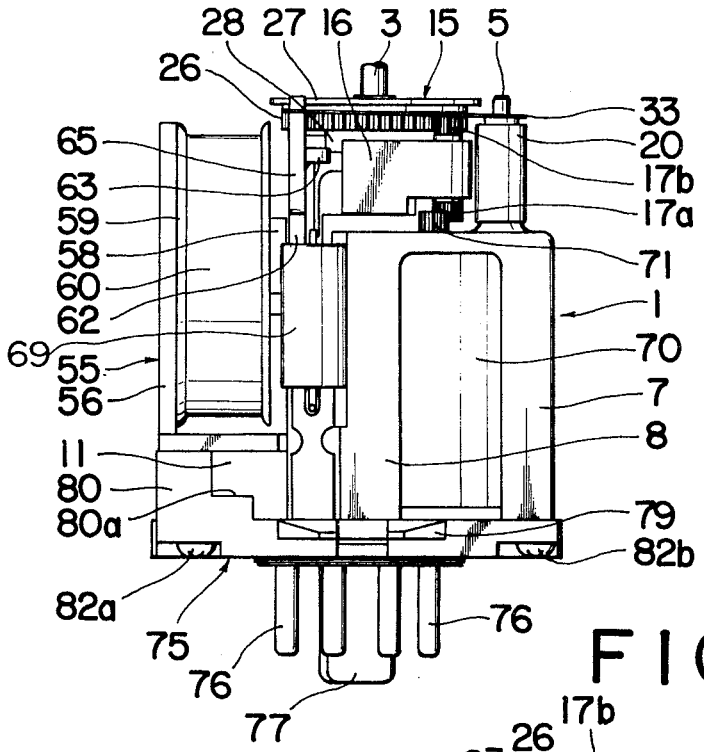
FIG. 4 shows a schematic rear elevational view of the embodiment shown in FIG. 1.
Figure 5:
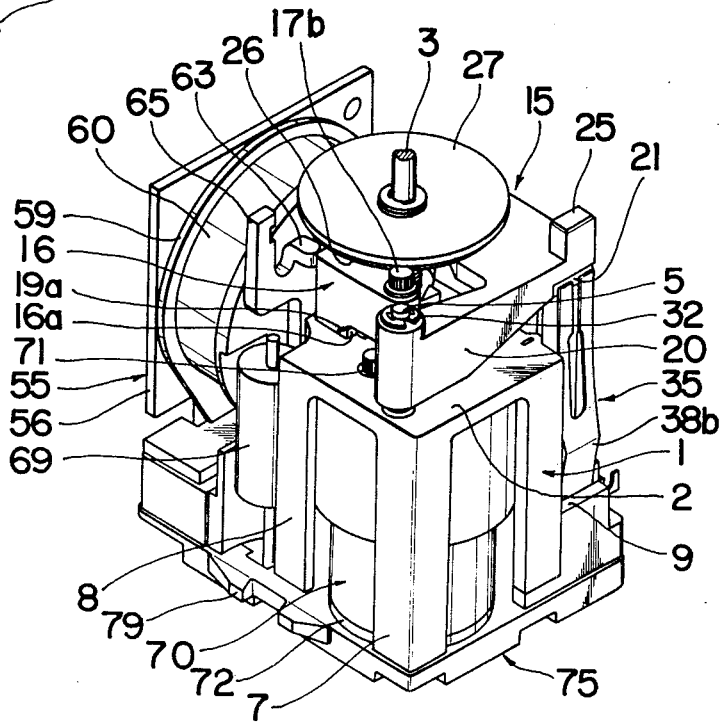
FIG. 5 shows a schematic perspective view of the embodiment shown in FIG. 1.

As best seen in FIG. 2, a contact assembly 35 comprises a stationary blade 36 having a stationary contact 37, movable blades **38*a* and 38*b* having movable contacts 39*a* and 39*b* respectively, a movable blade 41 having a movable contact 42, a stationary blade 43 having a stationary contact 44, a stationary blade 46 having a stationary contact 47, and movable blade 48 having a movable contact 49. Stationary contact 37 and movable contacts 39*a* and 39*b* form timing contacts for the timing device, movable contact 42 and stationary contact 44 are connected in series with a synchronous motor 70 and thus control the supply of power thereto and stationary contact 47 and movable contact 49 form an instantaneous contact. Strengthening plates 40*a*, 40*b*, 45 and 50 are attached at lower portions of the stationary and movable blades 38*a*, 38*b*, 43 and 48 respectively. The stationary and movable blades 36, 38*a* 38*b* 41, 43, 46 and 48 are press fitted in a plurality of grooves (not numbered) formed on the terminal holder 54 which is adapted for attachment to the attaching portion 9 of the frame 1. The strengthening plate 45 also functions as a stopper to restrict movement of the stationary blade 43**.

Top portions of the movable blades **38*a*, 38*b*, which confront each other, are engageable with the actuating projection 21 (FIG. 2) of the actuator 20. The movable blade 41, having a top portion engageable with the actuating projection 22 of actuator 20**, urges the actuator in the direction shown by arrow B.

The electromagnet comprises a yoke 56, a core 58 attached to the yoke 56, a spool 59, a coil 60, an armature 62 pivotably mounted on one end of said yoke 56, and a tension spring 61 biasing armature 62 away from core 68, i.e., in a counterclockwise direction as viewed in FIG. 2. The electromagnet 55 is attached to the attaching portion 11 of the molded frame 1 and the molded frame 1 is attached to the base member 75. The electromagnet 55 is held to the base member 75 by two screws **82*a* with the attaching portion 11 sandwiched therebetween. The armature 62 includes lever portion 63, (FIGS. 1, 4 and 5), 64 (FIGS. 1, 2 and 3) and 65 (FIGS. 1, 3, 4 and 5). Lever portion 63 is engageable with the face 16***b* of the arm 16, and the lever portion 64 has mounted thereon an adjustment piece 66 having a slot 67 therein. Adjustment piece 66 is adjustable in the direction shown by arrow D. An end 66*a* of the adjustment piece 66 is engageable with an end 22*a* of the actuator 20, and a stepped portion 66*b* is engageable with a top portion of the movable blade 48 of the contact assembly 35.

A plate 33 (FIGS. 2, 3, 4) for displaying the snap action movement of the armature 62 is attached at one end of the lever 65; a slot 34 is formed on the other end of the plate 33 in which stationary shaft 5 is inserted in order to guide the movement of the plate 33 in the direction shown by arrow C. The movement of plate 33 can be seen through an indicating window 88 formed on an upper surface 86 of the housing 85 thereby indicating whether the solenoid 55 is energized or not.

A synchronous motor 70 includes a reduction gear system (not numbered) and a drive gear 71 projecting upwardly from the reduction gear system through hole 6 of mounting base 6, and is placed in a space 12 of the molded frame 1, with drive gear 71 being engageable with the gear 17*a*.

The base member 75 includes pin terminals 76, (FIGS. 2 and 4), a positioning projection 77 on a bottom side, and lead wires 78 on a top side which are connected to pin terminals 76. The base member is adapted to be mounted in a socket (not shown). The electromagnet 55 is held to the base member 75 by two screws 82*a* (FIG. 2) with the attaching portion 11 of the molded frame 1 sandwiched between the yoke 56 of the electromagnet 55 and a stepped portion 80*a* of the base member 75. Supporting portions 7 are also held to the base member 75 by two screws 82*b* (FIG. 2). A rubber plate 72 is placed between the synchronous motor 70 and the base member 75 for protecting the synchronous motor 70 from hitting base member 75.

Each of lead wires 78 is connected to one of the stationary or movable blades 36, 38*a*, 38*b*, 41, 43, 46, and 48. A resistor 69 is placed beside a supporting portion 8 of the molded frame 1, and is connected in circuit with synchronous motor 70.

A housing 85 is made of a one-piece plastic assembly and has a hole 101 formed in an upper surface 85. Stationary shaft 3 projects through hole 101 and has a knob (not shown) mounted thereon having a pointer for setting a desired time delay. The housing 85 covers the molded frame 1, and the two are locked together by projections 79 formed on the base member 75 which cooperate with slots 91 formed on the bottom portion of the housing 85.

Blades 46 and 48 are connected to two of the pin terminals 76 and serve to control a load (not shown). Similarly, blades 36, 38*a* and 38*b* are connected to another three of the pin terminals 76 and serve to control another load (not shown). Blades 41 and 43 are connected in series with the synchronous motor 70 with the series connection being connected with another two of the pin terminals 76 which have power applied thereto. Electromagnet 55 is connected in parallel with the series connection of synchronous motor 70 and blades 41 and 43.

The operation of the aforementioned timing device is as follows:

When the power is turned off, the armature 62 of the electromagnet 55 is rotated counter-clockwise as viewed in FIG. 2, and the lever 63 pushes the arm 16 thereby rotating it in a direction opposite to that shown by arrow A (FIGS. 1, 5) so that the gear 17*a* is disengaged from the drive gear 71 while the gear 17*b* maintains its engagement with the driven gear 26. The actuator 20 is rotated in a direction opposite to that shown by arrow B as the end 22*a* is pushed by the adjustment piece 66 attached to the lever 64. As as result of the foregoing, contacts 37 and 39*a*, and contacts 42 and 44 are closed and contacts 37 and 39*b*, and contacts 47 and 49 are opened. For setting a delay time, the driven gear 26 is rotated via the knob (not shown) in a direction opposite to that shown by arrow A.

When power is applied to the electromagnet, armature 62 is attracted by the core 58 and rotates clockwise as viewed in FIG. 2, which releases the pressure on both the arm 16 and the actuator 20. As a result, the arm 16 is rotated by the spring 19 in the direction shown by arrow A about the stationary shaft 3 and the gear 17*a* engages with the drive gear 71 while the gear 17*b* maintains its engagement with the driven gear 26.

Additionally, the stepped portion 66*a* of the adjustment piece 66 releases its pressure on movable blade 48, resulting in a closing of contacts 47 and 49. Since contacts 42 and 44 are closed, the synchronous motor 70 starts to rotate. The rotation of the synchronous motor 70 is transmitted to the driven gear 26 through the gears 17*a* and 17*b* rotating the driven gear 26 in the opposite direction shown by arrow A against the spring force of spring 19. As the driven gear 26 rotates to a predetermined angle which was preselected by the knob in accordance with the desired delay, that is, the preset time expires, the lug 23 of the actuator 20 which slides on the cam 28 drops into the cut-out portion 28*a* of cam 28 so that the actuator 20 which is urged by the movable blade 41 rotates about the stationary shaft 5 in the direction shown by arrow B. As a result of this rotation of the actuator 20, movable contact 39*a* breaks contact with stationary contact 37; the movable contact 39*b* makes contact with the stationary contact 37; and the contact between the contacts 42, and 44 is opened to thereby stop the synchronous motor 70.

Since the power is now turned off, the armature 62 rotates counterclockwise as viewed in FIG. 2 and returns to the first position pushing back both the arm 16 and the actuator 20 to their first positions. Thus, gear 17*a* is disengaged from the drive gear 71, contacts 39*b* and 37 and contacts 47 and 49 are respectively opened, and contacts 42 and 44 are closed.

Although a particular embodiment of the invention has been described in detail with reference to the accompanying drawings, it is to be understood that the invention is not limited to the precise embodiment disclosed and that various changes and modifications may be readily effected by one skilled in the art without departing from the spirit or scope of the invention which is defined solely by the appended claims.

What is claimed is:

1. A timing device comprising:

a contact assembly;

a contact actuator for actuating said contact assembly;

an electromagnet for resetting said contact actuator in response to a reset signal;

a driven gear containing a cam surface thereon controlling movement of said contact actuator;

a motor for driving said driven gear;

means for coupling said motor to said driven gear;

a molded frame to which said contact assembly, said contact actuator, said electromagnet, said means for coupling and said motor are attached;

a housing covering said molded frame; and a base member to which said electromagnet is attached, said molded frame being partially sandwiched and fixed between said base member and electromagnet.

2. A timing device as in claim 1, wherein said electromagnet is attached to the base member by at least one fastening device.

3. A timing device as in claim 1, wherein said contact assembly and said electromagnet are attached to said molded frame so that the moving direction of an armature of said electromagnet and the moving direction of the contact blades of said contact assembly are in parallel.

4. A timing device as in claim 1, wherein the contact assembly is attached to the molded frame so that one side of said contact assembly is located adjacent said base member and the contact blades of said contact assembly extend upwardly from said base member.

5. A timing device as in claim 4, wherein the contact actuator is attached to the molded frame so that said actuator touches the free ends of the contact blades which are located on a side of said contact assembly opposite to that side which is adjacent said base member.

6. A timing device as in claim 1, wherein the molded frame is made of plastic.

7. A timing device as in claim 1, wherein the contact assembly is attached to the molded frame so that said contact assembly is arranged in a narrow space located between said molded frame and said housing, said molded frame and said housing both being made of plastic.

8. A timing device as in claim 1, wherein the terminals of said timing device are located at the bottom side of the device adjacent said base member and the time setting means is located at the top side of said timing device.

9. A timing device as in claim 1, wherein said housing is attached to said base member.

10. A timing device of claim 9, wherein said housing and said base member form a substantially closed space in which said motor, contact assembly, contact actuator, electromagnet, means for coupling, and molded frame are enclosed.

11. A timing device comprising:

a molded plastic frame;

a plastic housing covering said molded frame;

a contact assembly attached to a side portion of said molded frame;

a contact actuator attached to a top portion of said molded frame;

an electromagnet for resetting said control actuator arranged on another side portion of said molded frame and attached to a projection on said molded frame;

camming means mounted to said frame causing movement of said contact actuator;

a motor arranged in a space enclosed by said molded frame and attached to said molded frame for controlling movement of said camming means; and, a base member attached to a bottom portion of said molded frame.

* * * * *